US008833684B2

(12) United States Patent
Pallmann

(10) Patent No.: US 8,833,684 B2
(45) Date of Patent: Sep. 16, 2014

(54) CUTTING UNIT AND DEVICE FOR COMMINUTING BULKY FEEDSTOCK

(75) Inventor: Hartmut Pallmann, Zweibruecken (DE)

(73) Assignee: Pallmann Maschinenfabrik GmbH & Co. KG, Zweibruecken (DE)

( * ) Notice: Subject to any disclaimer, the term of this patent is extended or adjusted under 35 U.S.C. 154(b) by 397 days.

(21) Appl. No.: 13/283,525

(22) Filed: Oct. 27, 2011

(65) Prior Publication Data

US 2012/0104130 A1 May 3, 2012

(30) Foreign Application Priority Data

Oct. 27, 2010 (DE) ..... 10 2010 049 486

(51) Int. Cl.

| | |
|---|---|
| ***B02C 19/00*** | (2006.01) |
| ***B02C 18/00*** | (2006.01) |
| ***B02C 18/02*** | (2006.01) |
| ***B02C 18/22*** | (2006.01) |

(52) U.S. Cl.

CPC ..... *B02C 18/02* (2013.01); *B02C 2201/06* (2013.01); *B02C 18/2225* (2013.01)

USPC ..... 241/101.4; 241/199.3; 241/199.11

(58) Field of Classification Search

USPC ..... 241/101.4, 101.2, 243, 73; 83/408

See application file for complete search history.

(56) References Cited

U.S. PATENT DOCUMENTS

| | | | | |
|---|---|---|---|---|
| 2,889,878 | A * | 6/1959 | White et al. | 83/165 |
| 3,254,687 | A * | 6/1966 | Tertyshnikov | 241/88.2 |
| 3,584,796 | A * | 6/1971 | Earle et al. | 241/4 |
| 4,355,765 | A * | 10/1982 | Parker et al. | 241/152.2 |
| 4,476,185 | A * | 10/1984 | Spittle | 442/402 |
| 5,452,860 | A * | 9/1995 | Williams | 241/78 |
| 6,487,949 | B1 * | 12/2002 | Dharia | 83/213 |
| 7,201,339 | B2 * | 4/2007 | Ford | 241/92 |
| 7,631,825 | B2 | 12/2009 | Pallmann | |

FOREIGN PATENT DOCUMENTS

DE 10 2004 051 217 A1 5/2006

* cited by examiner

*Primary Examiner* — Faye Francis

(74) *Attorney, Agent, or Firm* — Muncy, Geissler, Olds & Lowe, P.C.

(57) ABSTRACT

A cutting unit for comminuting bulky feedstock and a device into which such a cutting unit is integrated. The cutting unit has a cutting chamber, which is arranged along a conveying direction and is formed by paired opposite cross walls and longitudinal walls. A knife for comminuting the feedstock can be moved transverse to the conveying direction across the entire cross section of the cutting chamber from one cross wall to the opposite cross wall. To also assure the complete cutting through of fiber-containing or film-shaped feedstock, a counter knife is arranged in the cross wall opposite to the blade of the knife which is stationary relative to the cutting chamber and which during the cutting process forms a cutting gap with the blade of the knife. The wall segment of the opposite cross wall is placed movable in the advance direction of the knife.

13 Claims, 5 Drawing Sheets

CUTTING UNIT AND DEVICE FOR COMMINUTING BULKY FEEDSTOCK

This nonprovisional application claims priority under 35 U.S.C. §119(a) to German Patent Application No. DE 10 2010 049 486.0, which was filed in Germany on Oct. 27, 2010, and which is herein incorporated by reference.

BACKGROUND OF THE INVENTION

1. Field of the Invention

The invention relates to a cutting unit for comminuting bulky feedstock and a device having such a cutting unit.

2. Description of the Background Art

The meaning and purpose of the industrial comminuting of feedstock is often the production of an intermediate product of predefined shape and size, which is then used as the starting material for a subsequent production process. Cited as examples are the comminuting of film bales, which are supplied as shredded film to an agglomerator to produce granules, or the comminuting of large-sized feedstock, such as, for example, rubber bales, which must be reduced to a relatively small final size such as, for example, granules. The uniformity in shape and size of the material leaving a comminuting step in this regard has a significant effect on the quality of the end product produced in the following processing step. In this respect, a precise and reliable precomminuting is extremely important.

DE 10 2004 051 217 A1, which corresponds to U.S. Pat. No. 7,631,825, discloses a device with two-step comminuting, in which rubber bales are converted to granules. The first comminuting step is integrated into the supply channel to the second comminuting step and consists of a cutting unit, whose knife crosses the cross section of the supply channel and thereby divides large-sized bales into smaller pieces. For this purpose, the rubber bale is held by a retaining element, arranged upstream of the knife, in the cutting position, whereas the blade of the knife penetrates through the rubber bale and moves obtusely against a rigid back stop on the opposite wall of the supply channel. Such devices have proven successful in practice in the granulation of large-sized rubber bales.

SUMMARY OF THE INVENTION

The object of the present invention is the further development of prior-art devices, particularly the field of application thereof, by suitable structural measures in regard to the comminuting of fiber-containing or film-like materials or the expansion of the recycling of reusable materials.

An advantage of the invention results from the reliable, complete separation of the feedstock between two cutting cycles as a result of the novel interaction of the knife and counter knife in the cutting chamber. The blades, shearing past each other, of the knife and counter knife separate feedstock with substantially one or two dimensions, for example, fibers and films, completely from the large-sized feedstock, which has a positive effect on the material flow through the cutting unit and thereby the operational safety of the device. Because the quality of the comminuted stock depends decisively on its condition, complete fragmentation of the feedstock without remnants into smaller individual units is of vital importance.

This advantage is noticeable especially in devices in which a cutting unit of the invention is integrated as a first comminuting step into the infeed to the second comminuting step. Therefore, the cutting unit of the invention not only has the task of precomminuting but also that of specified metering of suitable cycle times for the knife. Owing to the reliable complete cutting through the feedstock at the end of a cycle, it is possible to charge the second comminuting step with an amount and type of feedstock that is always the same. The resulting constant general conditions for the second comminuting process allow a selective optimization of the technical equipment and process parameters, so that a device of the invention can always be operated in the optimal performance range without any failures. This provides the advantage that the quality of the end product is exceptionally high with a simultaneously reduced energy consumption.

The type of cutting process with the shearing knife and counter knife is achieved in that the wall opposite to the counter knife or the corresponding wall segment is movable, so that an overlapping cut by the knife and counter knife is possible owing to the drawing back of the wall. Advantageously, the corresponding wall segment is as small as possible and corresponds approximately to the cross section of the knife, in order not to negatively impact the back stop function of the cutting chamber wall during the cutting process. This does not rule out, however, that the movable wall segment could also extend over the entire wall of the cutting chamber or half of the wall.

In an embodiment of the invention, the movable wall segment can be disposed in a recess in the wall and completely fills it in the wall plane to maintain a flush complete wall surface. The thus continuously planar inner sides of the cutting chamber provide for a trouble-free charging of the cutting chamber with the feedstock, because no edges impede the material flow. To assure a drawing back of the wall segment out of the wall plane, the recess has a depth that corresponds to a multiple of the thickness of the wall segment. The depth of the recess can be, for example, 40 mm or more.

In an embodiment of the invention, the movability of the wall segment can be achieved by a first linear guide, which during the drawing back of the wall segment causes a positive guiding of the wall segment in the advance direction of the knife. This assures that also after a plurality of cutting cycles the wall segment precisely fills the recess opening in the cutting chamber wall.

A simple and thereby very reliable type of linear guidance is achieved by means of a guide bolt, which is anchored with one of its ends fixedly in the movable wall segment and is seated with its other end longitudinally movable in guide holes in the cutting unit, for example, at the base of the wall recess.

In another embodiment of the invention, the movable wall segment can be elastically pretensioned against the advance direction of the knife, so that after the cut has been made the movable wall segment follows the beginning backward movement of the knife. Not only is a flush inner surface of the cutting chamber achieved thereby with the aforementioned advantages, but simultaneously a clearing is achieved of the recess, which becomes partially free, during the drawing back of the wall segment. The recess is therefore cleaned of small particles in the feedstock with each cutting cycle; these would otherwise collect and accumulate there.

The pretensioning force in this case can be generated in different ways. Thus, the arrangement of an elastically deformable layer between the wall segment and the base of the recess is conceivable, which is compressed when the wall segment draws back and moves the wall segment toward the cutting chamber during the return of the knife. This type of layer can be connected force-fittingly to the wall segment and the recess, for example, by gluing, and thus retain the wall segment, whereas the inner sides of the recess form the linear guide of the wall segment.

Another type of pretensioning can be achieved according to the invention by arranging spring elements between the wall segment and recess, which are tensioned during the drawing back of the wall segment. This solution is characterized by its simplicity and reliability.

To maintain a synchronous motion of the knife and wall segment, driving elements are provided for the motion drive of the wall segment; during the forward movement of the knife, these elements act on the wall segment. This occurs in a simple but effective way according to the invention by means of driving elements, which are attached rigidly to the knife frame and extend slightly into the cutting chamber. During the movement of the knife frame and thereby of the knife, the driving elements with their overhang come up against the wall segment and press it with a sustained forward movement into the recess. Alternatively, the driving elements can also be integrated in the knife, whereby the active surface of the driving elements should run slightly ahead of the knife's blade, for example, by 1 mm to 3 mm.

In terms of a cutting guidance as precise as possible, according to an embodiment of the invention, it is provided to retain the knife within a knife frame, which is guided in the cutting plane along a second linear guide. Preferably, the linear guide is formed by two stationary guide rods, along which the knife frame can be moved like a sled. An especially rigid frame construction, therefore suitable for precise guidance, provides two axis-parallel bars with a lateral clearance for the formation of the knife frame, said bars to which the knife is attached and which have through openings in their longitudinal axes, through which the guide rods extend.

The retaining element securing the feedstock during the cutting process is preferably also attached to the knife frame and thereby contributes in addition to reinforcing the knife frame. This brings the advantage, moreover, that a separate drive for the retaining element is not necessary, because its movement is coupled to the movement of the knife by the mutual arrangement on the knife frame.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
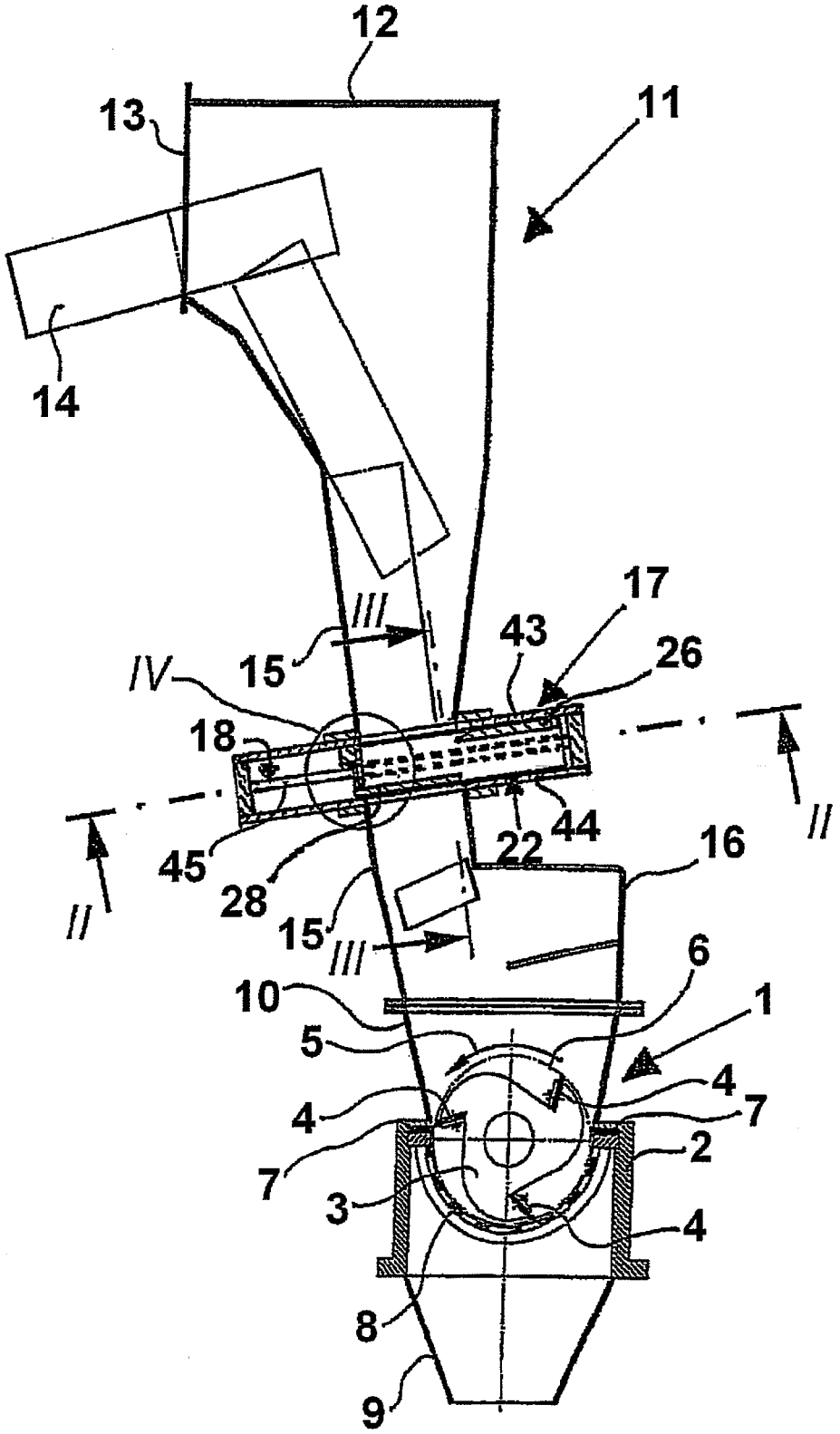
FIG. 1 shows a vertical section through a device of the invention.

FIG. 1 shows a cutting unit 17 of the invention in combination with a cutting mill 1 as the second comminuting step, which alternatively could also be formed by a shredder, a hammer mill, an agglomerator, or the like. Cutting mill 1 has a box-shaped housing 2, which serves to accommodate a cutting rotor 3 rotatably mounted around a horizontal axis. Cutting rotor 3 has three arms, each supporting a knife 4 oriented parallel to the axis of rotation. During the rotation of cutting rotor 3 in the direction of arrow 5, knives 4 form a mutual blade orbit 6.

The comminuting of the feedstock occurs with two stator knives 7, which are positioned diametrically opposite relative to the axis of rotation and whose effective edges are approximately tangent to blade orbit 6. The lower area of cutting orbit 6 is covered by a perforated screen 8, through which the sufficiently comminuted material exits the cutting area of cutting mill 1. A funnel-shaped material discharge 9, through which the end product is removed from cutting mill 1 for further use, is attached downward to housing 2.

The upper circumference of cutting rotor 3 is enclosed by a funnel-shaped housing part 10, which is adjacent to supply system 11 for the feedstock. The upper segment of supply system 11 is formed by an intake chute 12, which has a lateral opening 13. The feedstock can be fed to supply system 11 via opening 13. Large-sized feedstock in the form of film bales 14 is shown by way of example in FIG. 1. Other possible feedstock consists, for example, of rubber bales, electronic waste, carpet remnants, collections of recyclables, and the like. Intake chute 12 extends downward in the direction of cutting mill 1 in the shape of a rectangular supply channel 15 and connects with a cap-shaped part 16 to housing part 10 which is open at the top. Cutting unit 17 is inserted in supply channel 15 via flange connections and is thus integrated into supply system 11.

Figure 2:
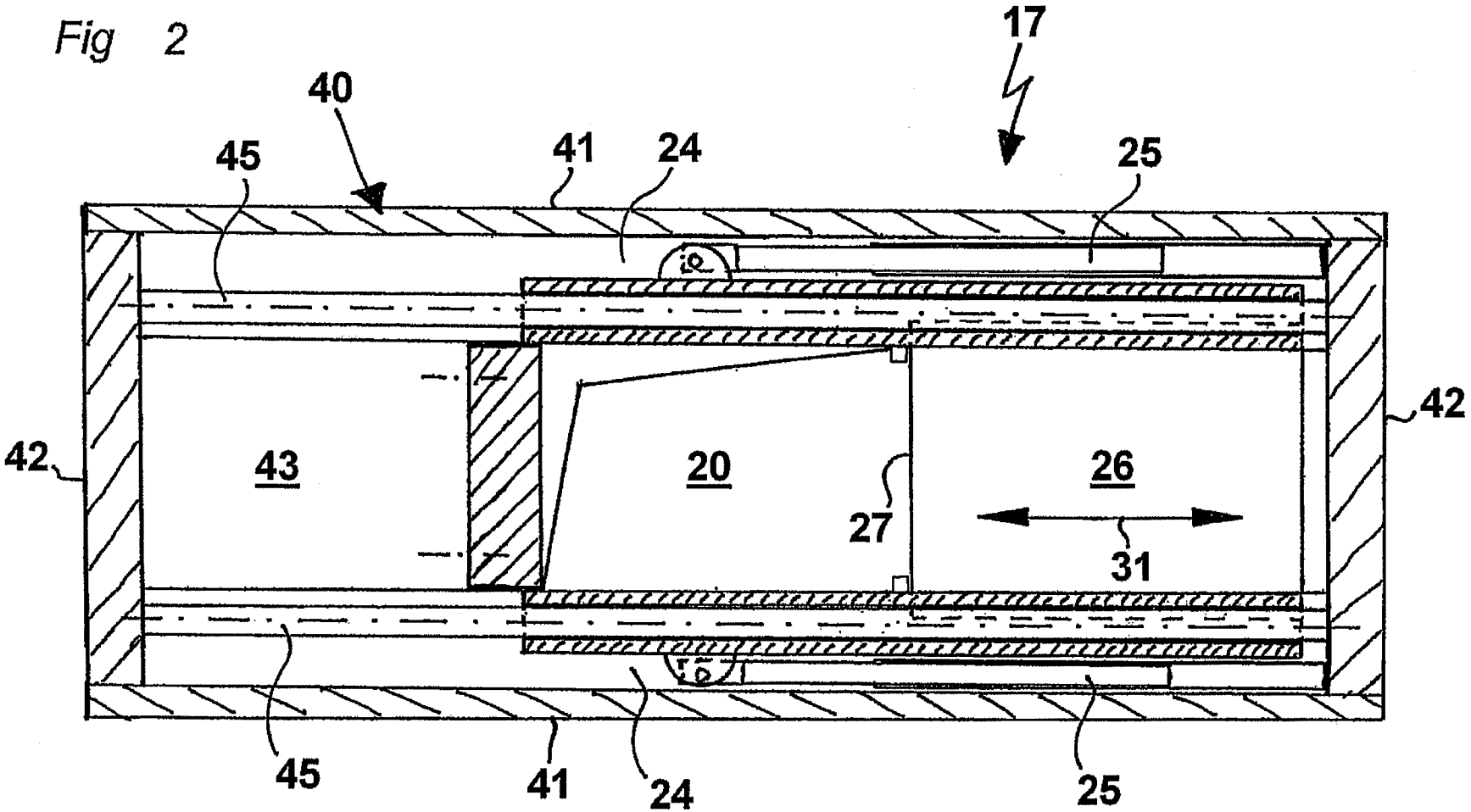
FIG. 2 shows a section through the device shown in FIG. 1 along the line II-II there.
Figure 3:
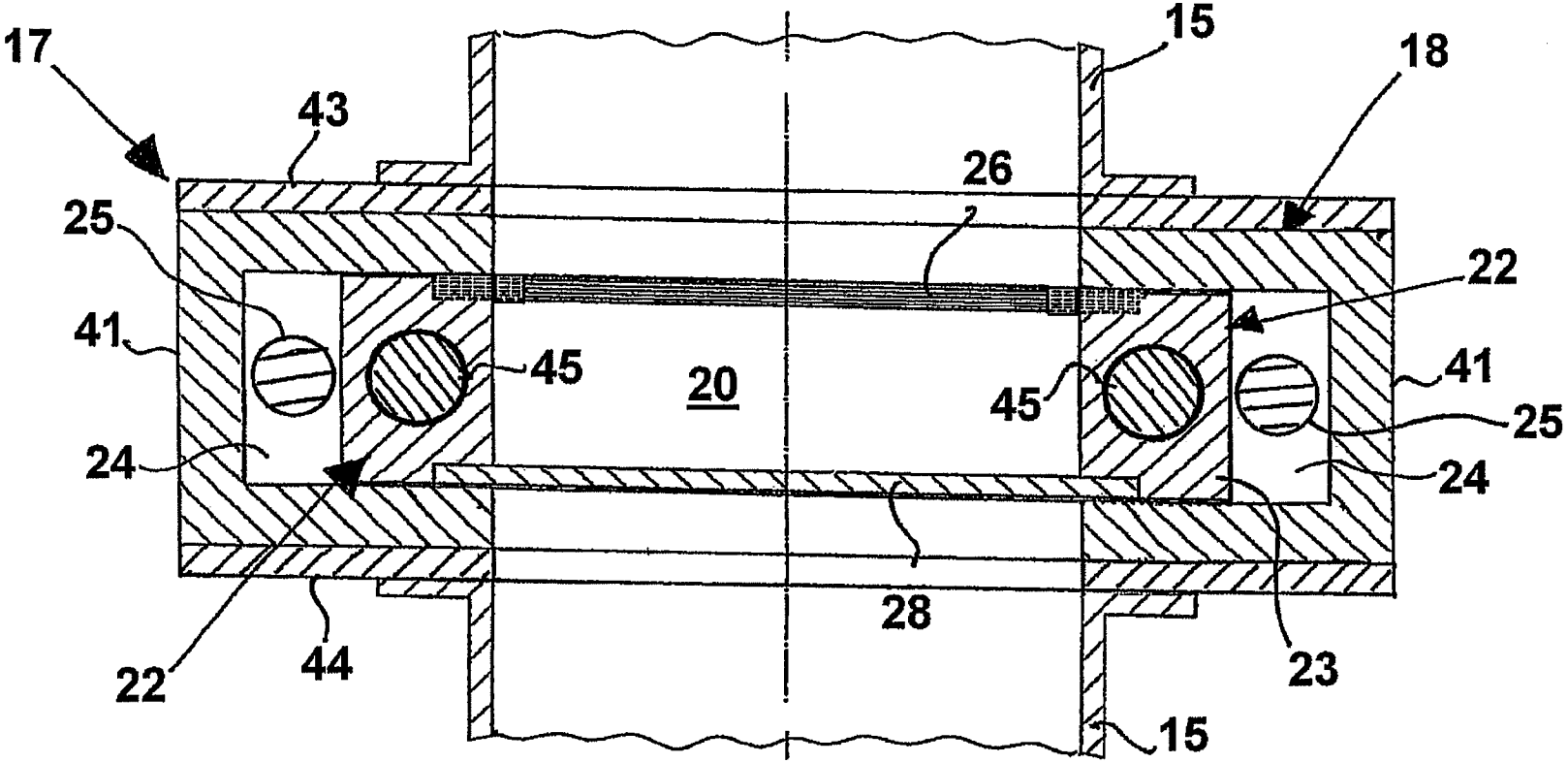
FIG. 3 shows a section through the device shown in FIG. 1 along the line III-III there.
Figure 4:
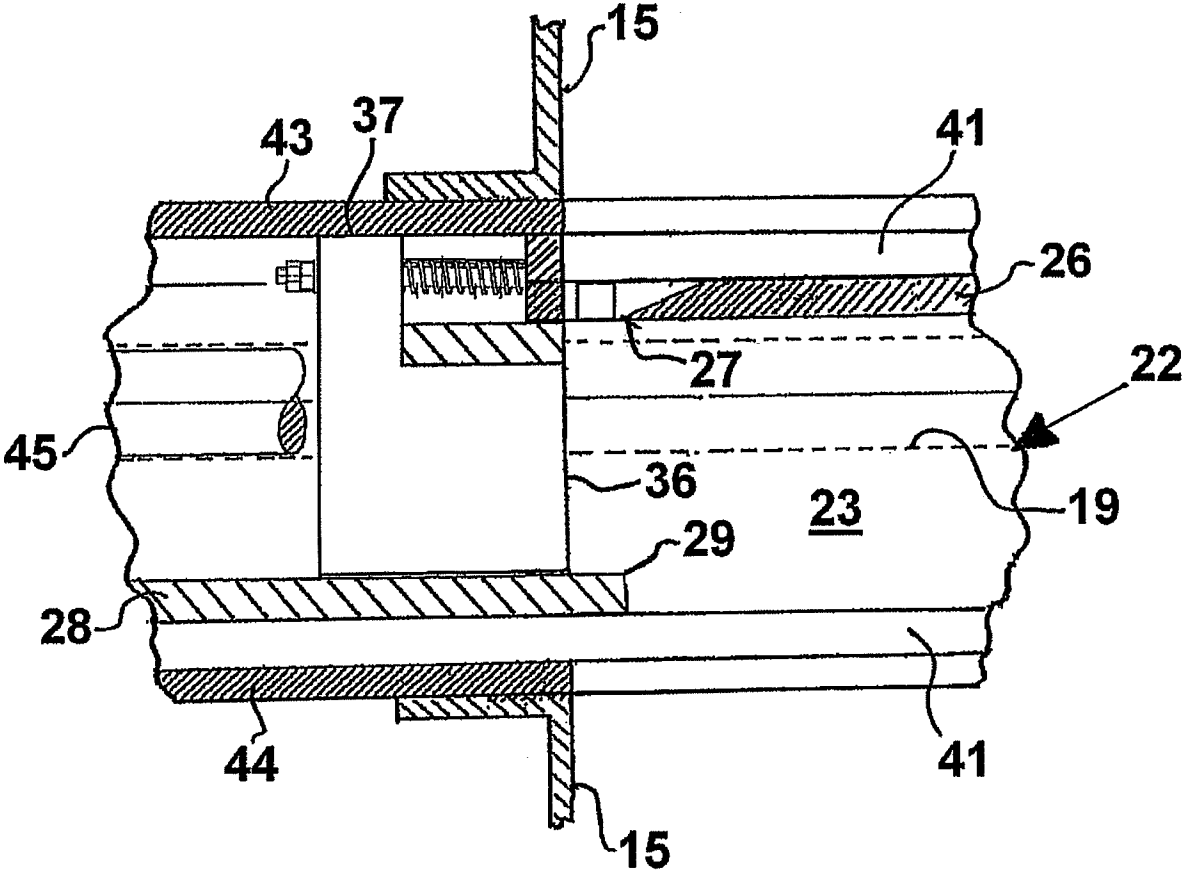
FIG. 4 shows a detail of the device shown in FIG. 1 in the area IV designated there.

The more detailed construction of cutting unit 17 is evident, apart from FIG. 1, primarily in FIGS. 2 to 4. Cutting unit 17 has a rigid circumferential rectangular frame 40, which is made up of longitudinal frame sections 41 and cross frame sections 42. To form a housing, frame 40 is closed with a cover plate 43 and a bottom plate 44. Cutting unit 17 is inserted in supply channel 15, therefore replaces it in the relevant section, whereby the frame plane is oriented perpendicular to the conveying direction of supply channel 15. To enable an unimpeded material flow, cutting unit 17 has a cutting chamber 20 which is aligned with the cross section of supply channel 15 and is formed by paired opposite longitudinal and cross walls.

The longitudinal frame sections 41 are formed U-shaped in cross section, whereby the open sides each face cutting chamber 20. In the enclosed area of each longitudinal frame section 41, a guide rod 45 with a circular cross section is arranged, whose ends integrate rigidly into transverse frame section 42. Guide rods 45 are part of a linear guide on which a knife frame 22 is positively guided.

Knife frame 22 consists substantially of two axis-parallel, laterally spaced longitudinal bars 23, whose length is about two-thirds of guide rods 45. The cross-sectional height of longitudinal bars 23 is matched to that of the rectangular region enclosed by the longitudinal frame sections 41. The facing inner sides of longitudinal bars 23 run approximately flush with the inner side of supply channel 15 and there form the two longitudinal walls of cutting chamber 20. The opposite outer sides of longitudinal bars 23 maintain a clearance distance to the web of longitudinal frame section 41. A cylinder piston unit 25 for driving knife frame 22 is disposed in each case in chamber 24 arising in this way; the stationary cylinder of the piston unit is mounted on frame 40 and the movable piston is articulated to knife frame 22. In their longitudinal axis, longitudinal bars 23 are each provided with a through hole 19 (FIGS. 2 and 3), with which they sit movably on guide rods 45.

Knife frame 22 includes further a plate-shaped knife 26, which with its lateral edges is inserted flush in the top sides of longitudinal bars 23, which there have a strip-shaped offset for this purpose. Knife 26 therefore connects the two longitudinal bars 23 in the transverse direction and extends in the longitudinal direction somewhat over the right half of knife frame 22 as shown in the exemplary embodiment, whereby blade 27 of knife 26 ends approximately at half the length of knife frame 22. In a similar way, attached to the bottom side of longitudinal bars 23 is a likewise plate-shaped retaining element 28, which extends, however, over the left half of knife frame 22 within the plane of the illustration and ends with its free edge 29 also in the middle of knife frame 22. Thus, knife 26 and retaining element 28 are arranged at a distance one above the other in plane-parallel planes, and free edge 29 and blade 27 coincide in the vertical projection onto the frame plane. Knife frame 22 in this way forms a type of sled, whose one frame half is occupied only by knife 26 and whose other frame half in the parallel plane beneath by retaining element 28.

Knife frame 22 is therefore arranged with its longitudinal bars 23 movable along the guide rods 45 forming a linear guide. The U-shaped longitudinal frame sections 41 in this case form a second outer guide for longitudinal bars 23 of knife frame 22. Knife frame 22, as symbolized by arrow 31, can be moved linearly back and forth by activating cylinder piston units 25, whereby in the one end position retaining element 28 closes supply channel 15, whereas knife 22 unblocks the cross section of supply channel 15, and in the other end position knife 26 closes supply channel 15, whereas retaining element 28 unblocks supply channel 15 in the downward direction.

FIG. 4 shows in detail the region of cutting unit 17 where the cutting process is carried out, namely, at a time shortly before knife 26 has reached its end position. A beam-shaped back stop 36 can be seen, which with its front side 30 forms a cross wall of cutting chamber 20 and is connected laterally rigidly in each case to longitudinal frame section 41. The height of back stop 36 is selected in such a way that retaining element 28 below back stop 36 and above a distance block 38, connected to the lower part of longitudinal frame section 41, can be moved into and out of cutting chamber 20.

In the region opposite blade 27 of knife 26, back stop 36 has a recess 50, which extends over the entire width of cutting chamber 20 and in this way produces a web 37 running parallel at a distance to the cross wall of cutting chamber 20. A counter knife 51 is screwed with its lower side onto the side, plane-parallel to the cutting plane, of recess 50. The opposite top side of counter knife 51 forms a cutting gap during the cutting process with the lower side of knife 26. Counter knife 51 ends with its cutting edge facing cutting chamber 20 approximately in the wall plane of cutting chamber 20.

The residual cross section of recess 50, said section remaining between the top side of counter knife 51 and the bottom side of cover plate 43, is occupied by a wall cross section 52 which is rectangular in outline and is placed movably in recess 50 in the advance direction of knife 26. The movement of wall segment 52 occurs along a linear guide with two guide bolts 53, whose relative position to back stop 36 is shown by a dashed line in FIG. 2. Guide bolts 53 are each anchored with their one end rigidly in wall section 52, for example, by screwing in. Their other ends extend through guide holes 39, running parallel to the advance direction, in web 37. The ends projecting from web 37 are each secured by means of lock nuts 47.

Because of the greater depth of recess 50 in relation to the thickness of wall section 52, a clearance distance results between web 37 and wall section 52, and this enables a moving back of wall segment 52 from the plane of the cutting chamber wall. Guide bolt 53 extends across this clearance distance and runs with this longitudinal section in each case within a compressed spring 46, which rests with one end against web 37 and with its other end against wall segment 52. An elastic pretensioning of wall segment 52 in the direction of knife 26 results in this way, so that upon interaction with the lock nut 47 acting as a stop, wall segment 52 is held in the plane of the cutting chamber wall.

To control the movement of the movable wall segment 52, in each case a rigid driving element 48, which projects slightly into cutting chamber 20, is arranged on the opposite sides of longitudinal bars 23 at the level of chipping knife 26 and directly before its blade 27. Driving element 48 therefore moves with knife frame 22 and thus synchronously with knife 26. During the cutting movement of knife 26, driving element 48 is moved in the direction of wall segment 52 and with a sustained cutting movement of knife frame 22 comes up against wall segment 34 and presses it into recess 50, even before blade 27 of knife 26 reaches counter knife 51 or wall section 52. Subsequently, blade 27 shears past the active cutting edge of counter knife 51, until knife 26 reaches its end position in which the blade 27 also comes to lie within recess 50.

Figure 5:
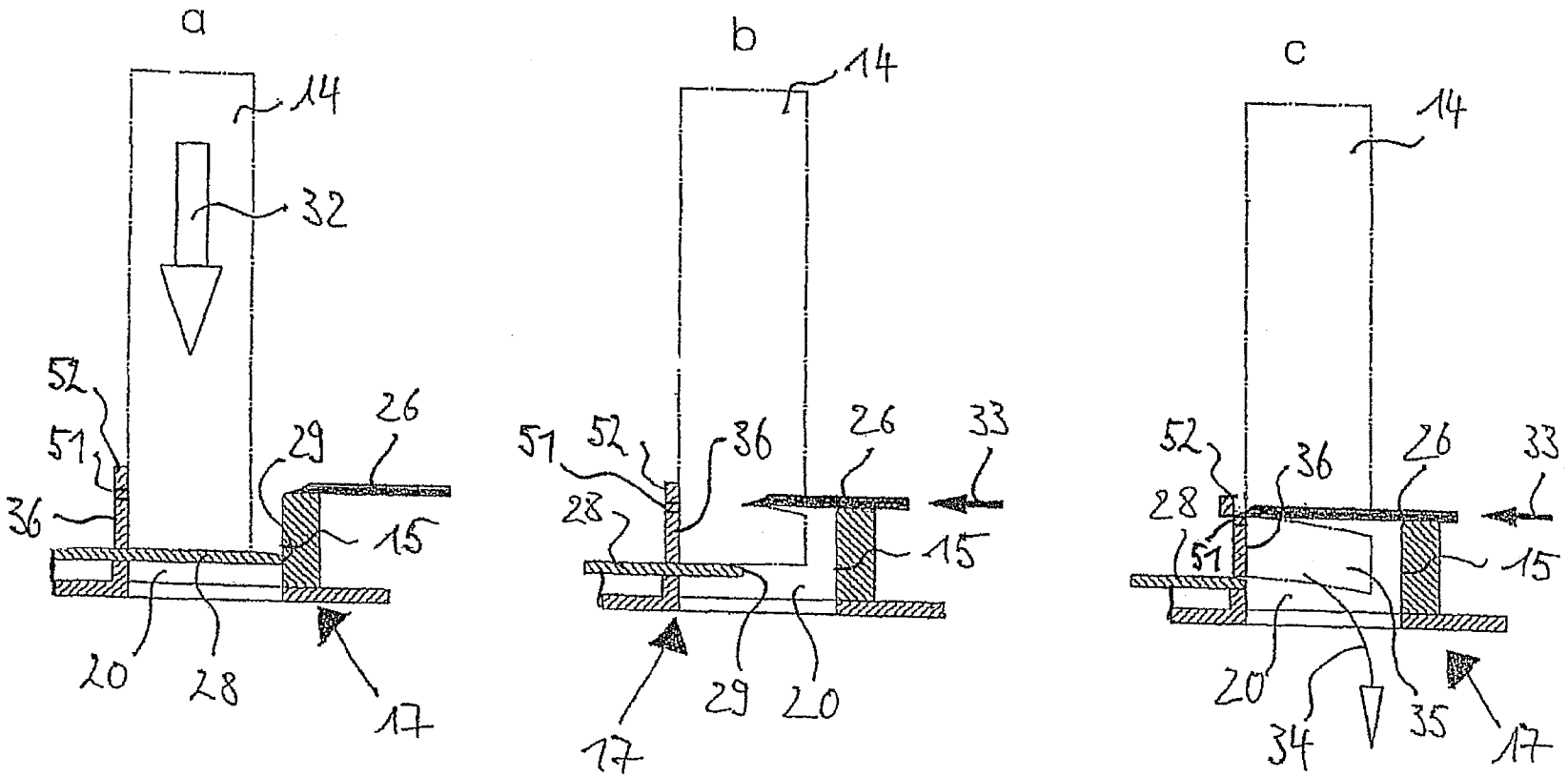
FIG. 5 shows schematic sketches of different operating states during the comminuting process.

FIGS. 5*a* to *c* show greatly simplified illustrations of the above-described invention, which will be used to describe the operation of cutting unit 17 below. In this regard, FIG. 5*a* shows the initial position of cutting unit 17 for the charging of the device with feedstock, here in the form of a film bale 14. Knife frame 22 is brought here by means of cylinder piston units 25 into a first end position, in which knife 26 completely unblocks cutting chamber 20 and retaining element 28 completely closes cutting chamber 20. In this case, free edge 29 of retaining element 28 is located at the inner side of supply channel 15. As shown by arrow 32, a film bale 14 according to its length enters the area of cutting unit 17 through supply channel 15 until it lies on retaining element 28.

FIG. 5*b* shows the beginning of the comminuting process. With the aid of cylinder piston units 25, knife frame 22 is moved in the direction of arrow 33. In so doing, knife 26 penetrates into film bale 14. At the same time, retaining element 28 begins to unblock cutting chamber 20.

Owing to the sustained advance of knife 26, cutting unit 17 reaches a second end position. This state is shown in FIG. 5*c*. In so doing, knife 26 moves across the entire cross section of supply channel 15, whereby driving elements 48 first move wall segment 52 in the advance direction 33 of knife 26, before blade 27 arrives at counter knife 51 and executes a shearing step. Retaining element 28 is completely pulled back out of cutting chamber 20 and thus unblocks the entire cross section of supply channel 15. This, owing to gravity, allows that the separated part 35 of film bale 14 reaches the second comminuting step in the direction of arrow 34, where the fine comminuting is carried out in cutting mill 1.

At the end of a cutting cycle, cutting unit 17 is again brought back to the first end position and thereby to the starting position for the next cutting cycle. During the comminuting, knife frame 22 therefore performs a linear sled-like movement, alternating between two end positions, transverse to supply channel 15, whereby to charge cutting unit 17, cutting chamber 20 is unblocked by knife 26 and closed by retaining element 28 and for cutting and further transport of the feedstock, cutting chamber 20 is closed during the cutting movement of knife 26 and unblocked by retaining element 28.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A cutting unit for comminuting bulky feedstock, the cutting unit comprising:

a cutting chamber arranged along a conveying direction, the cutting chamber being formed by paired opposite cross walls and longitudinal walls and whose one opening is used for supplying and whose opposite opening is used for removal of feedstock;

a knife that is configured to be movable for comminuting the feedstock transverse to the conveying direction across an entire cross section of the cutting chamber from one cross wall to the opposite cross wall;

a counter knife arranged at the cross wall opposite to a blade of the knife, the counter knife being stationary relative to the cutting chamber, and the counter knife being positioned below the knife in the conveying direction, such that during a cutting process, the blade of the knife shears past an active cutting edge of the counter knife, wherein a wall segment of the opposite cross wall, which is positioned above the counter knife, is movable in an advance direction of the knife.

2. The cutting unit according to claim 1, wherein the movable wall segment extends at least over length of an overlap of the blade of the knife and the counter knife and at least over the thickness of the knife.

3. The cutting unit according to claim 1, wherein the opposite cross wall for a movable seating of the wall segment has a recess, whose cross section in the wall plane of the cutting chamber corresponds to the outline of the movable wall segment and its depth to a multiple of the thickness of the movable wall segment, and wherein the movable wall segment is held via a first linear guide.

4. The cutting unit according to claim 3, wherein the first linear guide comprises at least one guide bolt, which is connected with its one end to the movable wall segment and which with its other end is seated longitudinally movable within a guide at the base of the recess.

5. The cutting unit according to claim 1, wherein the movable wall segment is elastically pretensioned against the advance direction of the knife.

6. The cutting unit according to claim 5, wherein for the elastic pretensioning of the movable wall segment, at least one spring element or an elastically deformable layer is arranged between the movable wall segment and a rigid outer support.

7. The cutting unit according to claim 1, wherein the knife is retained in a knife frame, which is placed movable within a second linear guide in the wall region of the device in the advance direction.

8. The cutting unit according to claim 1, further comprising at least one driving element that is coupled to the movement of the knife and that acts on the knife for the movement of the movable wall segment.

9. The cutting unit according to claim 7, wherein the at least one driving element is arranged rigidly on the knife frame or the knife.

10. A method for comminuting bulky feedstock having a first comminuting step and a second comminuting step, whereby as the first comminuting step a cutting unit according to claim 1 is integrated into the supply channel for the second comminuting step.

11. The cutting unit according to claim 1, further comprising a retaining element that is positioned parallel to the knife and is movable tranverse to the conveying direction across an entire cross section of the cutting chamber.

12. The cutting unit according to claim 1, wherein the counter knife is positioned directly below the movable wall segment in the conveying direction, such that movement of the movable wall segment in the advance direction of the knife exposes an upper surface of the counter knife.

13. A cutting unit for comminuting bulky feedstock, the cutting unit comprising:

a cutting chamber arranged along a conveying direction, the cutting chamber being formed by paired opposite cross walls and longitudinal walls;

a movable knife that is retained at one cross wall of the cutting chamber and that moves transverse to the conveying direction across an entire cross section of the cutting chamber from the one cross wall to the opposite cross wall; and a stationary counter knife retained at the opposite cross wall at a position that is downstream of the movable knife in the conveying direction, the stationary counter knife having an active cutting edge, wherein a segment of the opposite cross wall that is positioned upstream of the counter knife in the conveying direction, is movable from a position that is flush with the opposite cross wall to a retracted position that is recessed from the opposite cross wall, and wherein, when the knife is fully advanced across the entire cross section of the cutting chamber, a blade of the knife shears past the active cutting edge of the counter knife and advances into a recess formed by the retracted position of the movable segment.

* * * * *